US009902180B2

(12) United States Patent
Nishimura

(10) Patent No.: US 9,902,180 B2
(45) Date of Patent: Feb. 27, 2018

(54) PRINTER

(71) Applicant: Brother Kogyo Kabushiki Kaisha, Nagoya-shi, Aichi-ken (JP)

(72) Inventor: Yohei Nishimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/460,354

(22) Filed: Mar. 16, 2017

(65) Prior Publication Data

US 2017/0282622 A1 Oct. 5, 2017

(30) Foreign Application Priority Data

Mar. 31, 2016 (JP) ..... 2016-071861

(51) Int. Cl.

| | |
|---|---|
| ***B41J 35/36*** | (2006.01) |
| ***B41J 2/32*** | (2006.01) |
| ***B41J 33/22*** | (2006.01) |
| ***B41J 33/34*** | (2006.01) |
| ***B41J 33/54*** | (2006.01) |

(52) U.S. Cl.

CPC ..... *B41J 35/36* (2013.01); *B41J 2/32* (2013.01); *B41J 33/22* (2013.01); *B41J 33/34* (2013.01); *B41J 33/54* (2013.01)

(58) Field of Classification Search

CPC ..... B41J 33/22; B41J 33/54

See application file for complete search history.

(56) References Cited

U.S. PATENT DOCUMENTS 9,272,536 B2 * 3/2016 Tanaka ..... B41J 11/0075
2011/0292150 A1 12/2011 Ishii et al.

FOREIGN PATENT DOCUMENTS

JP 2001-047717 A 2/2001
JP 2011-245758 A 12/2011

* cited by examiner

*Primary Examiner* — Lisa M Solomon
(74) *Attorney, Agent, or Firm* — Banner & Witcoff, Ltd.

(57) ABSTRACT

The disclosure discloses a printer including a memory. The memory stores computer-executable instructions that, when executed by a processor, cause the printer to perform a first process, a second process, and a third process. In the first process, an N-th determination target value is calculated, from an N-th pulse count index value and an $(N+1)^{th}$ pulse count index value. In the second process, a mean value of a plurality of consecutive pulse count index values within a predetermined range is calculated. In the third process, a comparison value is calculated by comparing $(N-1)^{th}$ the determination target value with the mean value. The first process to the third process are performed while increasing N one by one. A first determination step includes determining whether the elongated medium has reached a consumption completion status or not, on the basis of a magnitude relation between the comparison value and a first threshold value.

11 Claims, 12 Drawing Sheets

[FIG. 1]
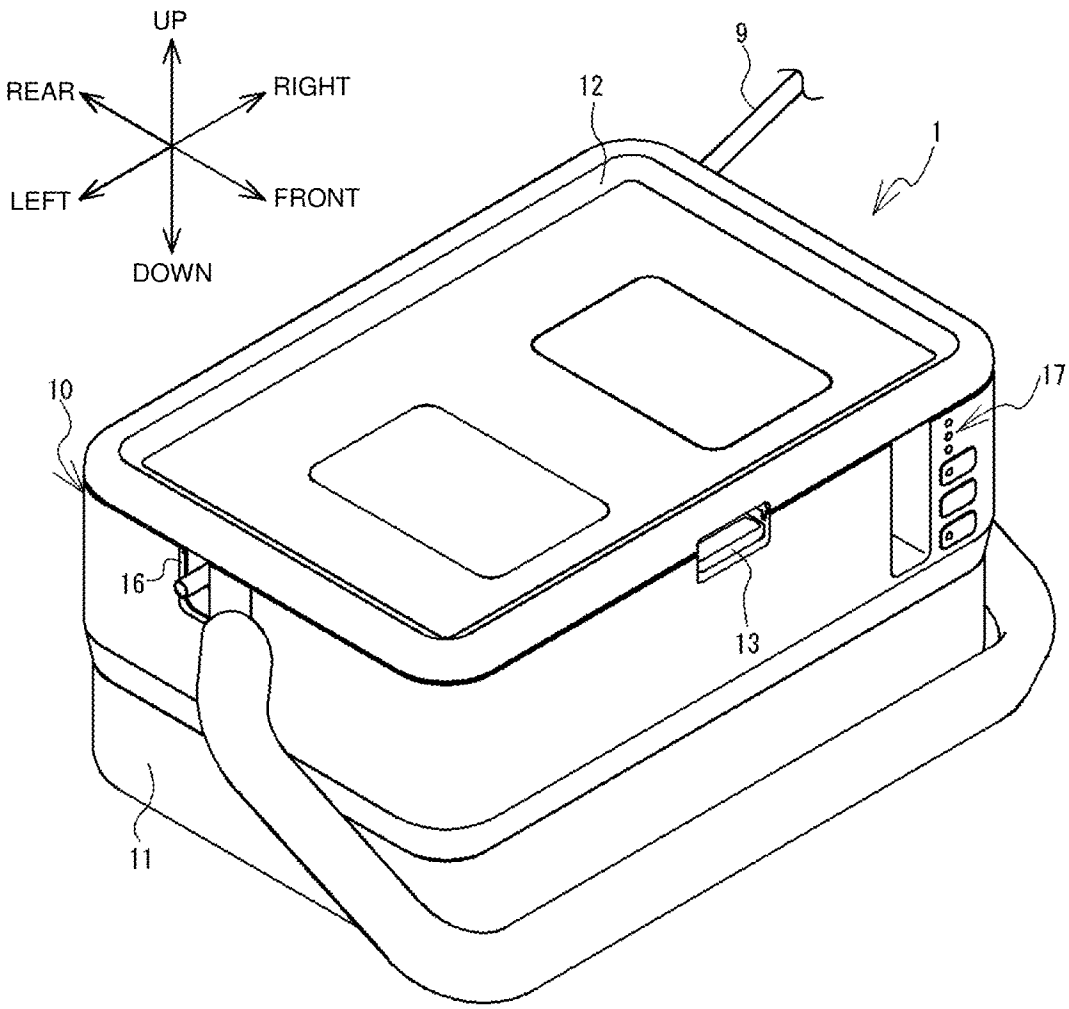

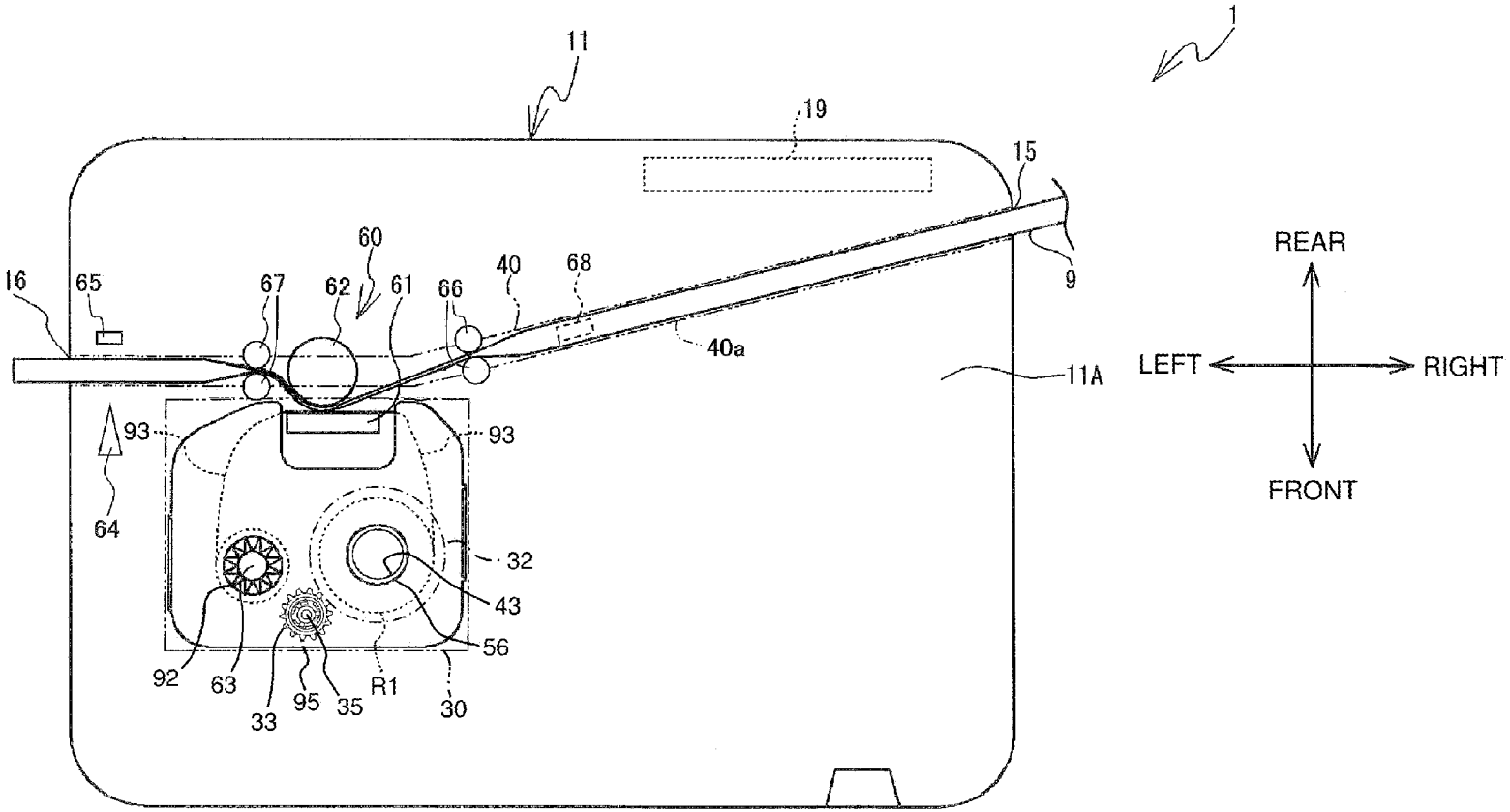
[FIG. 2]

[FIG. 3A]
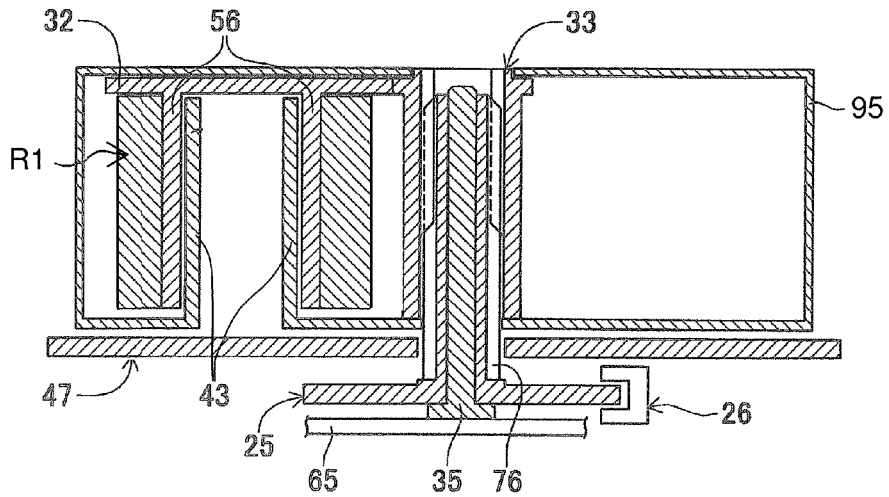
[FIG. 3B]
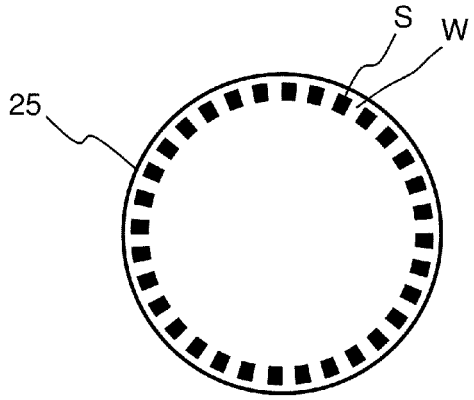

[FIG. 4]
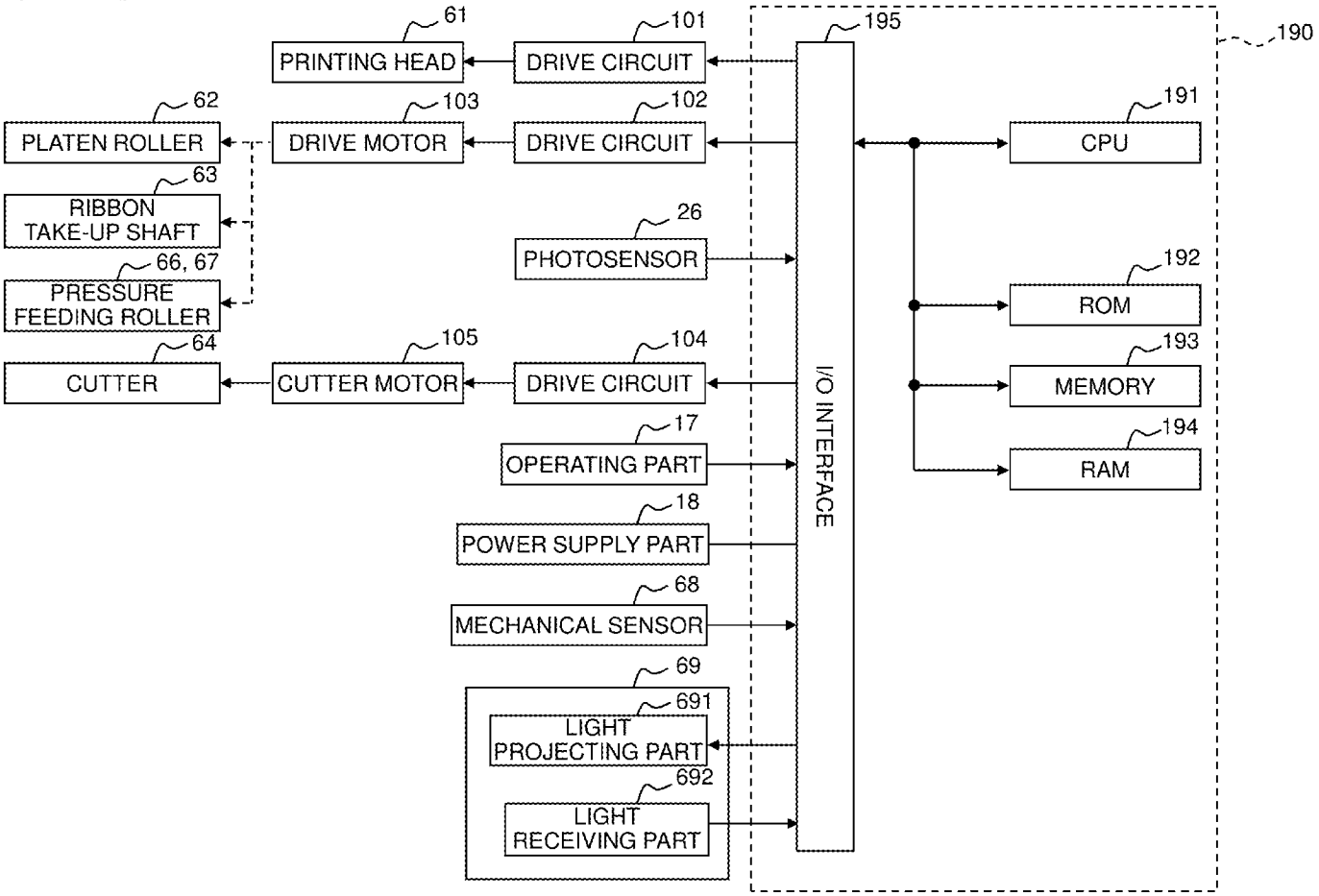

[FIG. 5A]
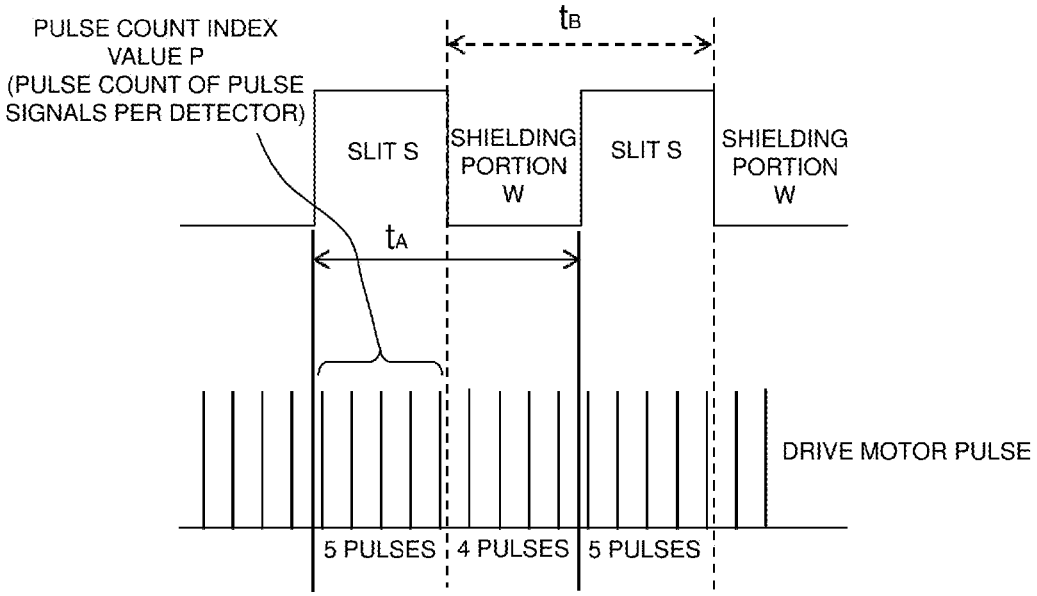
[FIG. 5B]
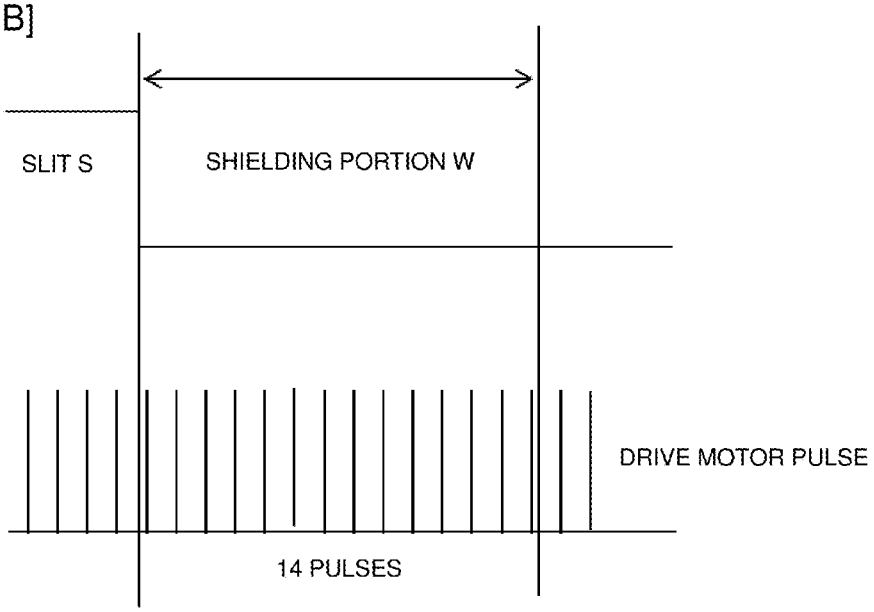

[FIG. 6A]
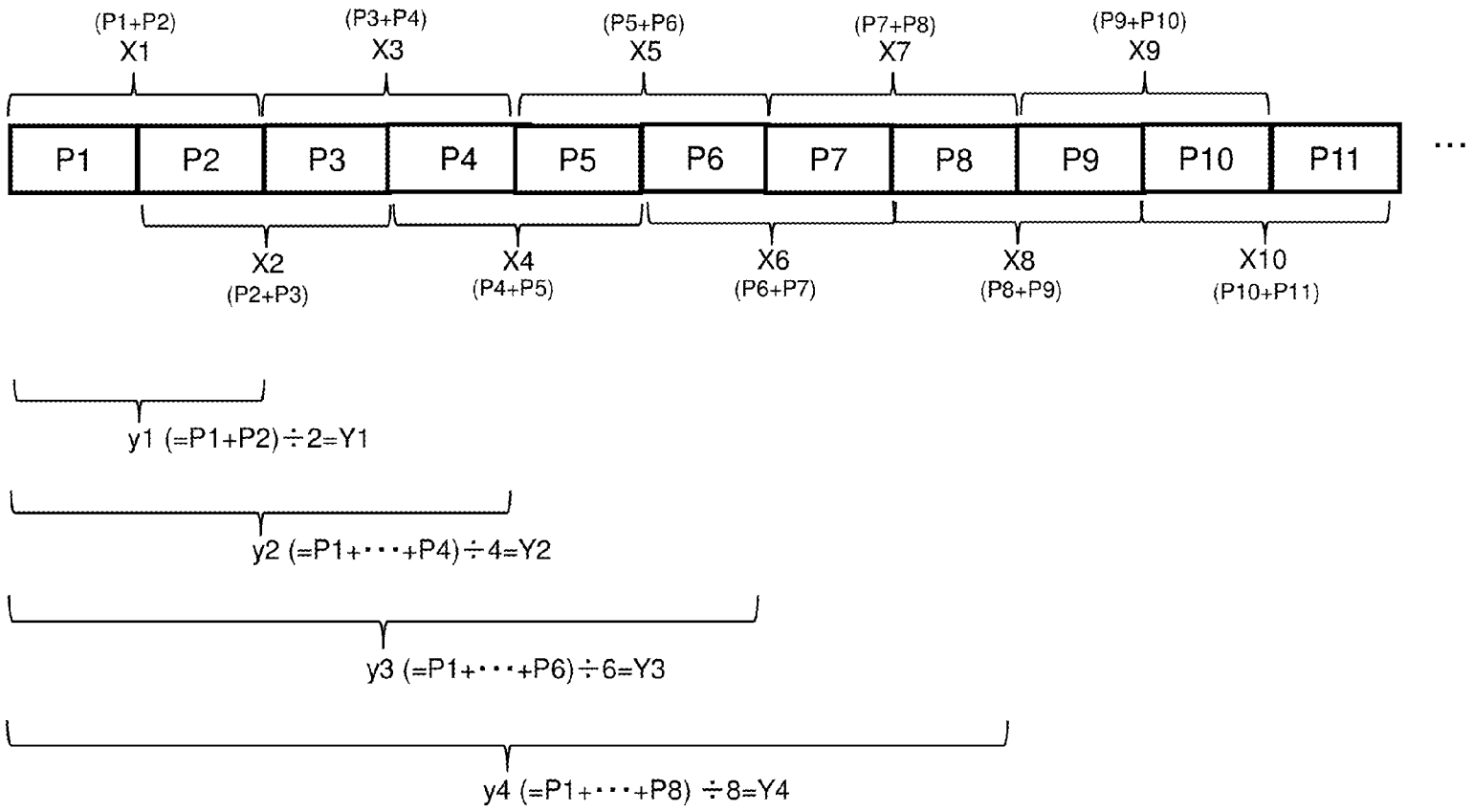

[FIG. 6B]

COMPARE AND DETERMINE USING ALL DATA UP TO DETECTED NTH DATA UNTIL THE NUMBER OF INDEX VALUE DATA EXCEEDS THE NUMBER (10 IN THIS EXAMPLE) OF DATA FOR ONE TURN OF ENCODER

| N | INDEX VALUE | k | DETERMINATION TARGET VALUE | COMPARISON VALUE | END DETERMINATION FORMULA |
|---|---|---|---|---|---|
| 1 | P1 | 1 | - | (NOT DETERMINED) | - |
| 2 | P2 | 1 | X1(=P1+P2) | (NOT DETERMINED) | - |
| 3 | P3 | 2 | X2(=P2+P3) | Y1=average(y1) | X2/(Y1 × 2)>α |
| 4 | P4 | 2 | X3(=P3+P4) | Y1=average(y1) | X3/(Y1 × 2)>α |
| 5 | P5 | 3 | X4(=P4+P5) | Y2=average(y2) | X4/(Y2 × 2)>α |
| 6 | P6 | 3 | X5(=P5+P6) | Y2=average(y2) | X5/(Y2 × 2)>α |
| 7 | P7 | 4 | X6(=P6+P7) | Y3=average(y3) | X6/(Y3 × 2)>α |
| 8 | P8 | 4 | X7(=P7+P8) | Y3=average(y3) | X7/(Y3 × 2)>α |
| 9 | P9 | 5 | X8(=P8+P9) | Y4=average(y4) | X8/(Y4 × 2)>α |
| 10 | P10 | 5 | X9(=P9+P10) | Y4=average(y4) | X9/(Y4 × 2)>α |

α: THRESHOLD VALUE

[FIG. 7A]
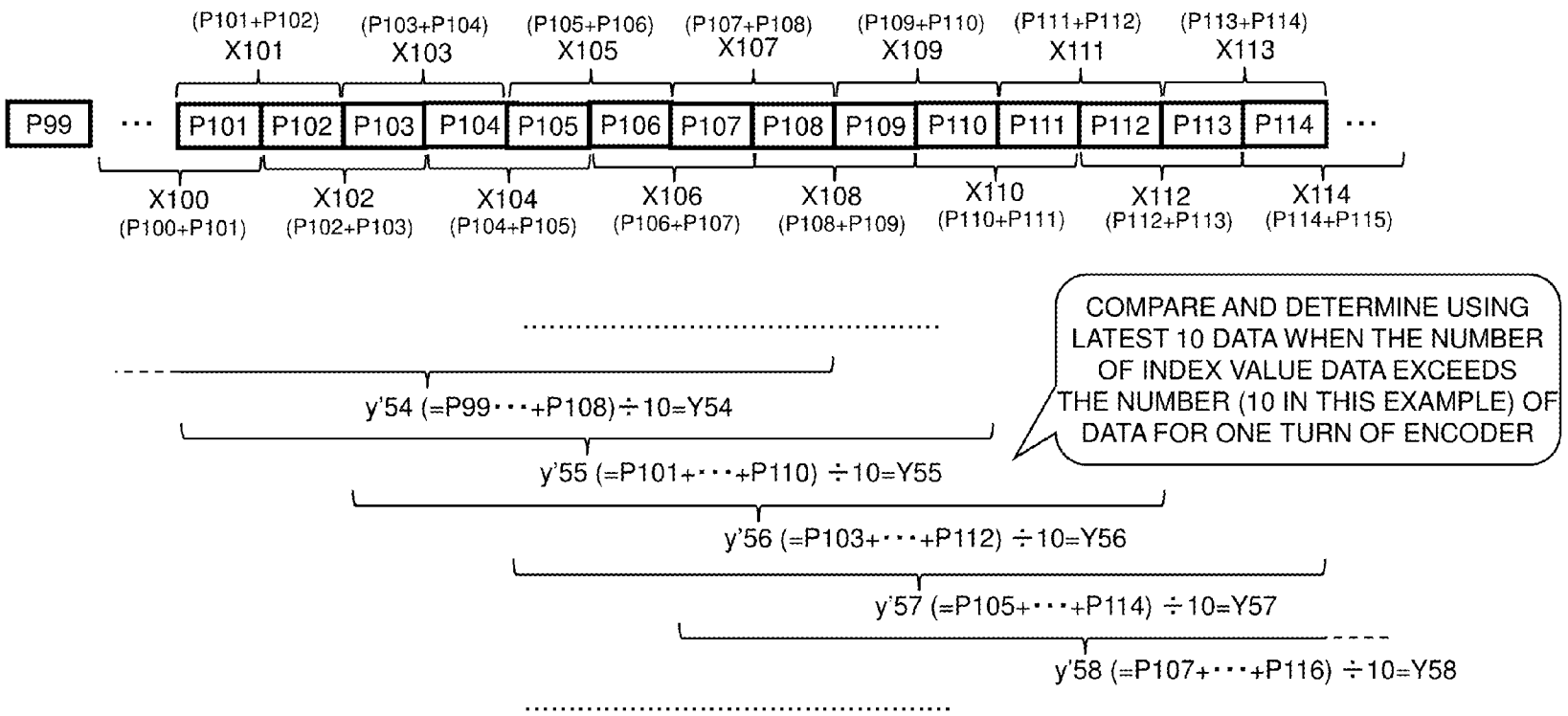

[FIG. 7B]

| N | INDEX VALUE | k | DETERMINATION TARGET VALUE | COMPARISON VALUE | END DETERMINATION FORMULA |
|---|---|---|---|---|---|
| .. | .. | . | .. | .. | .. |
| 109 | P109 | 55 | X108(=P108+P109) | Y54=average(y'54) | X108/(Y54 × 2)>α |
| 110 | P110 | 55 | X109(=P109+P110) | Y54=average(y'54) | X109/(Y54 × 2)>α |
| 111 | P111 | 56 | X110(=P110+P111) | Y55=average(y'55) | X110/(Y55 × 2)>α |
| 112 | P112 | 56 | X111(=P111+P112) | Y55=average(y'55) | X111/(Y55 × 2)>α |
| 113 | P113 | 57 | X112(=P112+P113) | Y56=average(y'56) | X112/(Y56 × 2)>α |
| 114 | P114 | 57 | X113(=P113+P114) | Y56=average(y'56) | X113/(Y56 × 2)>α |
| 115 | P115 | 58 | X114(=P114+P115) | Y57=average(y'57) | X114/(Y57 × 2)>α |
| .. | .. | . | .. | .. | .. |

α: THRESHOLD VALUE

[FIG. 8]
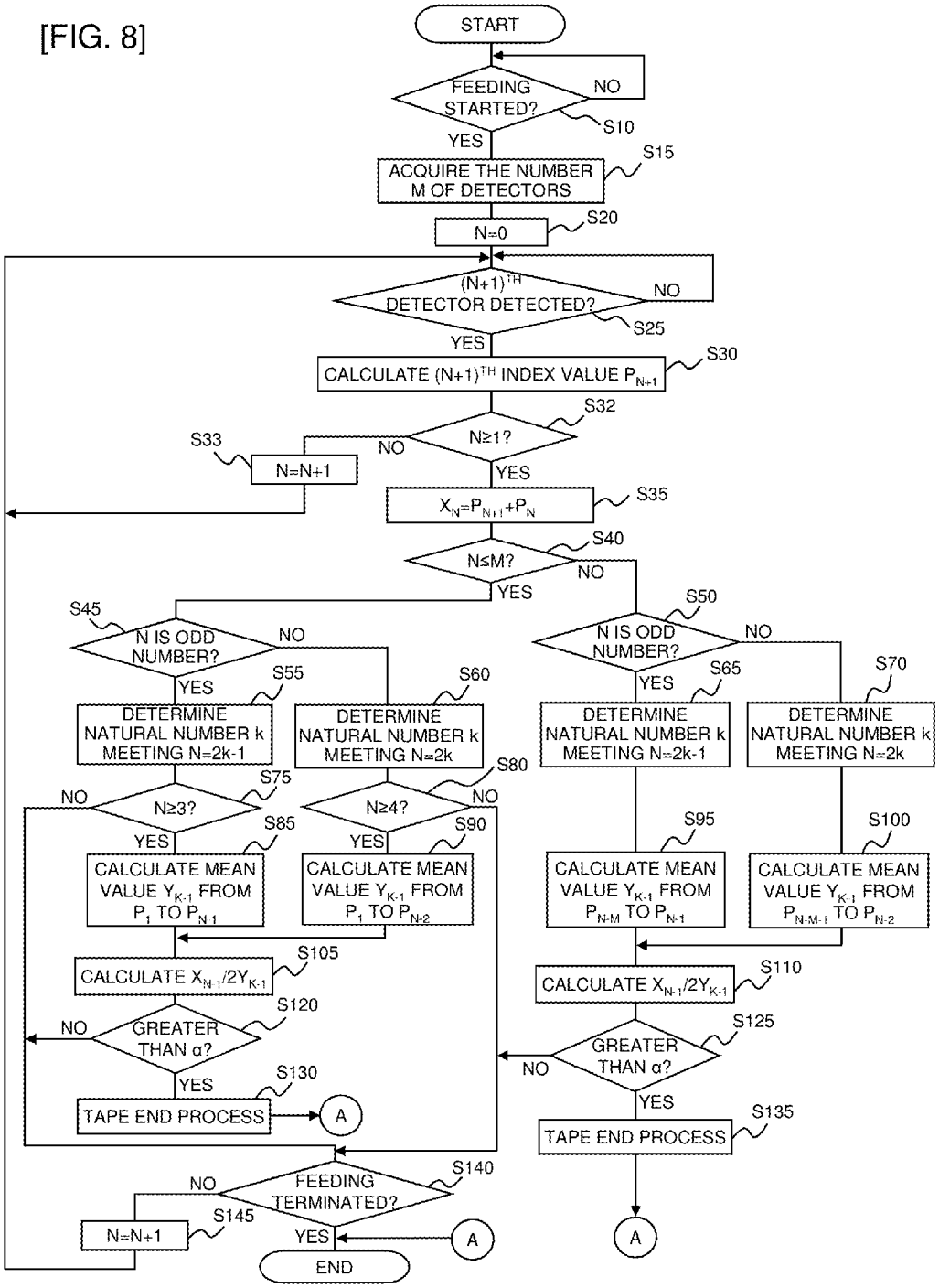

[FIG. 9]
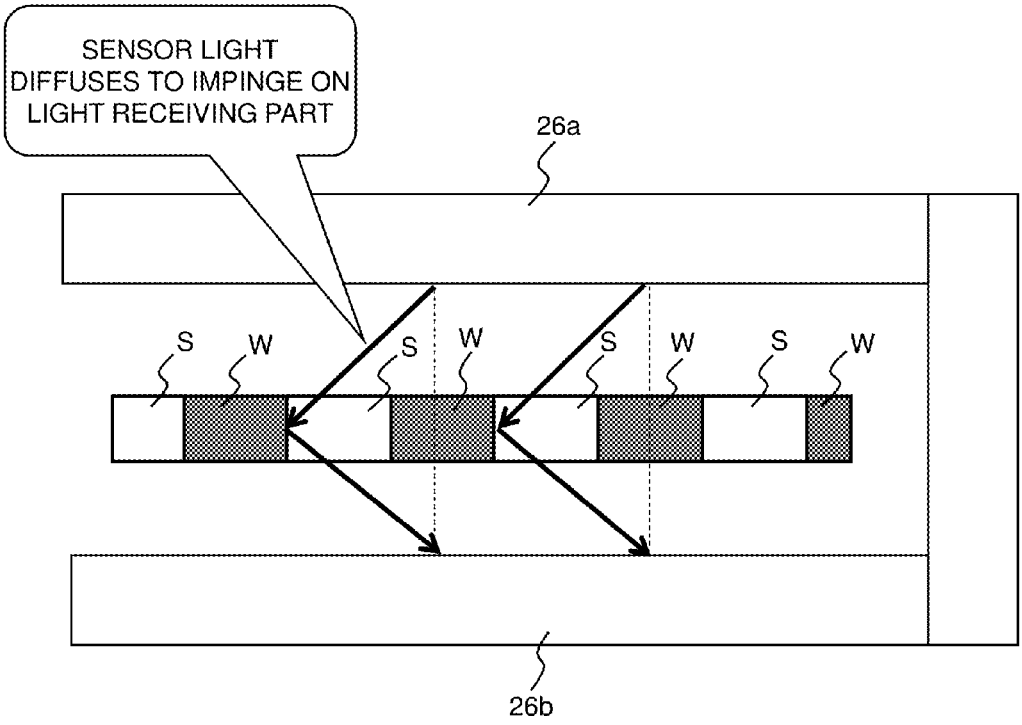

[FIG. 10]
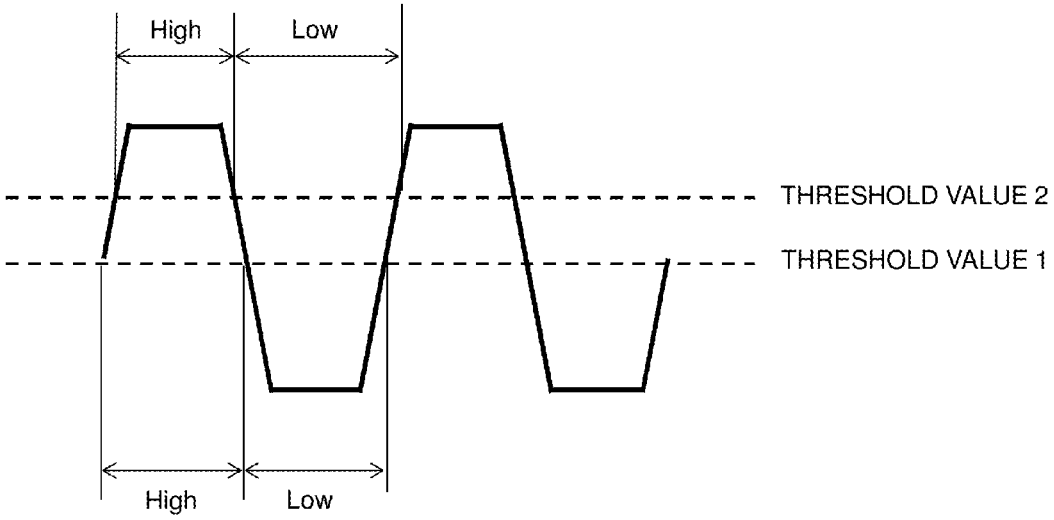

PRINTER

CROSS-REFERENCE TO RELATED APPLICATION

The present application claims priority from Japanese Patent Application No. 2016-71861, which was filed on Mar. 31, 2016, the disclosure of which is incorporated herein by reference in its entirety.

BACKGROUND

Field

The present disclosure relates to a printer performing print using an elongated medium.

Description of the Related Art

A printer has hitherto been known that detects a consumption completion status (so-called a tape end) of an elongated medium (an ink ribbon) consumed by use during printing. In this prior art, rotations of a body to be detected (a sensor plate) rotating in conjunction with a roll (an ink ribbon bobbin) into which an elongated medium is wound, are detected by an optical detection device (a rotary encoder) and counted as the pulse count. The total pulse count obtained at the time of execution of print is then compared with a termination definition pulse count preset corresponding to the full length of the elongated medium, so that the residual amount of the elongated medium is detected based on the difference value. When the detected residual amount becomes 0, the above consumption completion status is determined to have been achieved.

The above prior art, however, involves problems which follow. The consumption completion status cannot be detected until the counted pulse count value reaches the termination definition pulse count, rendering prompt detection difficult. Due to use of the counted pulse count value corresponding to the withdrawal amount (the feeding amount) of the elongated medium, for example, even if the elongated medium becomes loosened when handled by the operator or even if it is manually taken up (to eliminate the loosening), no support is provided resulting in a remarkably poor detection accuracy. The same applies to the case of abnormal feeding (so-called jamming) or roll replacement.

SUMMARY

It is therefore an object of the present disclosure to provide a printer capable of detecting the consumption completion status of an elongated medium promptly and with high accuracy.

In order to achieve the above-described object, according to aspect of the present application, there is provided a printer comprising a feeder, a pulse motor, a drive control device, a body to be detected, an optical detection device, a processor, and a memory. The feeder is configured to transport an elongated medium that is to be consumed during printing fed out from a roll that includes an outer periphery around which the elongated medium is wound. The pulse motor is configured to drive the feeder. The drive control device is configured to output a pulse signal for driving the pulse motor. The body to be detected is configured to rotate in conjunction with rotation of the roll, and includes M (M is an integer greater than or equal to 2) detected elements along a circumferential direction. The optical detection device is configured to optically detect the detected elements of the body to be detected. The memory stores computer-executable instructions that, when executed by the processor, cause the printer to perform a comparison value calculation step, an index value detection step, and a first determination step. The index value detection step includes detecting a pulse count index value expressed by a pulse count of the pulse signal per one of the detected elements, in sequence for each of the detected elements, in accordance with transport of the elongated medium by the feeder driven by the pulse motor. The comparison value calculation step includes a first process, a second process, and a third process. In the first process, an N-th determination target value to be determined is calculated, from an N-th (N: an integer greater than or equal to 1) pulse count index value from start of transport and an $(N+1)^{th}$ pulse count index value adjoining the N-th pulse count index value, among a plurality of the pulse count index values detected in sequence at the index value detection step. In the second process, a mean value of a plurality of consecutive pulse count index values within a predetermined range is calculated. The predetermined range has its latest value that is an $(N-1)^{th}$ pulse count index value when N is an odd number greater than or equal to 3 or is an $(N-2)^{th}$ pulse count index value when N is an even number greater than or equal to 4, among the plurality of the pulse count index values detected in sequence at the index value detection step. In the third process, a comparison value is calculated by comparing, with using a predetermined arithmetic operation, $(N-1)^{th}$ the determination target value among the determination target values calculated in sequence in the first process with the mean value calculated in the second process. The first process to the third process are performed in sequence while increasing N one by one with consumption of the elongated medium. The first determination step includes determining whether the elongated medium wound around the outer periphery of the roll has reached a consumption completion status or not, on the basis of a magnitude relation between the comparison value calculated at the comparison value calculation step and a predetermined first threshold value.

In the printer of the present disclosure, upon the execution of printing, an elongated medium wound into a roll is used. The pulse motor drives the feeder based on a pulse signal from the drive control device so that the feeder feeds out the elongated medium from the roll, for transport.

At that time, in the present disclosure, a body to be detected and an optical detection device are disposed in order to detect a consumption completion status (a so-called tape end) of the elongated medium fed out and transported as above. The body to be detected comprises M (M is an integer greater than or equal to 2) detected elements arranged at predetermined angular intervals in the circumferential direction and rotates in conjunction with rotation of the roll by the transport of the elongated medium. The detected elements disposed on the body to be detected are detected by the optical detection device through the rotation of the body to be detected, so that the pulse count index value (=the pulse count of pulse signals per one detected element) is detected in sequence in the index value detection processing executed by the processor. According as the elongated medium is consumed, the roll reduces in diameter and the angular velocity of the body to be detected rotated by the transport becomes faster, with the result that the pulse index value decreases gradually. When the elongated medium reaches the consumption completion status, the pulse index value increases to an extreme extent (since the body to be detected does not rotate irrespective of the drive of the pulse motor). Based on such a behavior, the consumption completion status can be detected from the fact that the detected elements are not detected regardless of output of a predetermined number of pulse signals for example.

In the present disclosure, to detect the above consumption completion status more promptly and with higher accuracy, comparison value calculation processing is executed. In this comparison value calculation processing, first in a first process, a determination target value is calculated from the N-th pulse count index value from the start of transport and the $(N+1)^{th}$ pulse count index value adjoining thereto. This has significance as follows.

In the case of performing the optical detection on the body to be detected as above, slits are formed on the body to be detected so that both the slits and the shielding portions between the adjacent slits function as the detected elements. By the optical detection, a convex pulse is detected from the slits for example and a concave pulse is detected from the shielding portions. At that time, if the slit width is equal to the width of the shielding portion on the body to be detected, the duration of the convex pulse and the duration of the concave pulse detected by the optical detection device should originally be the same. Actually, however, the duration of the convex pulse and the duration of the concave pulse may not be equal e.g. due to the influence of the wraparound phenomenon of light when passing through the slits or due to the magnitude relation between the threshold value set at the time of optical detection and the signal value. In spite of the occurrence of the above influences, however, the total duration of one convex pulse and one concave pulse is unvaried, in other words, the duration from the detection of the rising edge of a convex pulse from one slit to the detection of the rising edge of a next convex pulse, or the duration from the detection of the falling edge of a concave pulse from the shielding portion to the detection of the falling edge of a next concave pulse, is unvaried. Thus, the above concerns over the optical detection can be obviated to secure a high accuracy, by calculating the determination target value from the N-th pulse count index value (corresponding to either one of the convex pulse and the concave pulse) and the $(N+1)^{th}$ pulse count index value (corresponding to remaining one of the convex pulse and the concave pulse).

In the comparison value calculation processing, a mean value of a plurality of consecutive pulse count index values within a predetermined range is calculated in the second process, and thereafter a predetermined arithmetic operation is applied to the above determination target value and the above mean value in the third process, to calculate a comparison value. The mean value of the plurality of pulse count index values calculated in the second process can be used as a past actual value having high reliability without any influence of variations and fluctuations of the pulse count index values in the arithmetic operation of the third process.

In the present disclosure, the first process, second process and third process are performed from moment to moment while incrementing N with the consumption of the elongated medium in the comparison value calculation processing, and it is determined in the first determination processing whether the elongated medium has reached the consumption completion status, on the basis of the magnitude relation between the comparison values calculated from moment to moment and a predetermined threshold value (first threshold value). This enables the consumption completion status of the elongated medium to be detected more promptly and with higher accuracy than the conventional technique of detecting an arrival at a termination definition pulse count of a pulse count value corresponding to the amount of transport of the elongated medium or than the technique of simply waiting non-detection of the detected element S, W at the time of output of a predetermined number of pulse signals as described above.

BRIEF DESCRIPTION OF THE DRAWINGS

FIG. 1 is a perspective view showing an external appearance of a printer of an embodiment of the present disclosure.

FIG. 2 is a plan view showing an internal configuration of the printer.

FIG. 3A is a partially enlarged cross-sectional side view in the case where a ribbon cassette is mounted on a cassette storage part of the printer.

FIG. 3B is a plan view of an encoder plate.

FIG. 4 is a function block diagram showing a control system of the printer.

FIG. 5A is an explanatory view showing an example of a pulse index value.

FIG. 5B is an explanatory view showing another example of the pulse index value.

FIG. 6A is an explanatory view explaining the content of arithmetic processing performed by a CPU until an encoder plate achieves one turn of rotation.

FIG. 6B is another explanatory view explaining the content of arithmetic processing performed by the CPU until the encoder plate achieves one turn of rotation.

FIG. 7A is an explanatory view explaining the content of arithmetic processing performed by the CPU after the encoder plate achieves one turn of rotation.

FIG. 7B is another explanatory view explaining the content of arithmetic processing performed by the CPU after the encoder plate achieves one turn of rotation.

FIG. 8 is a flowchart showing a control procedure executed by the CPU.

FIG. 9 is an explanatory view showing an influence of the wraparound phenomenon of photosensor light.

FIG. 10 is an explanatory view showing the durations of detection pulses based on the magnitude relations between threshold values set at the time of optical detection and signal values.

DETAILED DESCRIPTION OF THE PREFERRED EMBODIMENTS

An embodiment of the present disclosure will now be described with reference to the drawings.

<Overall Schematic Configuration>

Referring first to FIGS. 1 and 2, an overall schematic configuration of a printer of the embodiment will be described. In the following description, upper, lower, lower right, upper left, upper right, and lower left of FIG. 1 are defined as top, bottom, front, rear, right, and left, respectively, of the printer.

In FIGS. 1 and 2, a printer 1 is a device having two printing mechanisms so as to be able to print both a tape (not shown) that is a strip-shaped print-receiving medium and a tube 9 that is a tubular print-receiving medium. In the diagrams, a configuration for printing the tape is not shown. A configuration for printing the tube 9 will mainly be described hereinbelow.

The printer 1 comprises a housing 10 that includes a body case 11 and a cover 12. The body case 11 is a box-shaped member in the shape of a transversely elongated rectangular parallelepiped. The cover 12 is a plate-shaped member disposed on top of the body case 11. The cover 12 has a rear end portion supported rotatably on top of the body case 11 at a rear end portion thereof. The cover 12 rotates its front end portion in the top-bottom direction so as to open and close a mounting surface 11A that is a top surface of the body case 11. The body case 11 has a lock mechanism 13 at a top front end portion. The lock mechanism 13 locks the front end portion of the cover 12 to restrain the cover 12 from opening when the cover 12 is closed on the body case 11.

When closed on the body case 11 (see FIG. 1), the cover 12 covers the mounting surface 11A. When opening the cover 12, the user operates the lock mechanism 13 to unlock the cover 12, allowing the cover 12 to rotate upward from the lock mechanism 13. When the cover 12 is opened from the body case 11 (not shown), the mounting surface 11A is exposed upward.

The housing 10 has on its side surfaces an operation part 17, a tube insertion port 15, and a tube discharge port 16. The operation part 17 is in the form of a plurality of operation buttons including a power button and a start button. The operation part 17 is disposed on a front surface at its upper right portion of the body case 11. The tube insertion port 15 is an opening for guiding the tube 9 to the interior of the housing 10. The tube insertion port 15 is disposed on a right surface at its upper rear portion of the body case 11 and is of a vertically slightly elongated rectangular shape. The tube discharge port 16 is an opening for discharging the tube 9 to the exterior of the housing 10. The tube discharge port 16 is disposed on a left surface at its upper rear portion of the body case 11 and is of a vertically slightly elongated rectangular shape. The tube discharge port 16 is positioned slightly frontward of the tube insertion port 15.

A ribbon cassette mounting part 30 and a tube mounting part 40 are arranged on the mounting surface 11A.

The ribbon cassette mounting part 30 is a part to/from which a ribbon cassette 95 is attached/detached. The ribbon cassette mounting part 30 is a recessed portion that opens upward and has an opening substantially corresponding in shape to the ribbon cassette 95 in a planar view. In this example, the ribbon cassette mounting part 30 is disposed on a left half of the mounting surface 11A and frontward of the tube mounting part 40.

The ribbon cassette 95 is a box-shaped body storing an ink ribbon 93. A ribbon spool 56 of a ribbon roll R1 and a ribbon take-up shaft 63 around which a used ink ribbon 93 is wound, are supported rotatably within the interior of the ribbon cassette 95. The ribbon roll R1 is a roll into which an unused ink ribbon 93 is wound around the ribbon spool 56.

In this case, as shown in FIG. 3A (see also FIG. 2), a cassette boss 43 extends vertically from a bottom surface of the ribbon cassette 95 to support the ribbon spool 56 in a rotatable manner. A disc-shaped ribbon gear 32 coaxial with the ribbon spool 56 is disposed between the ribbon roll R1 and a top surface of the ribbon cassette 95. The ribbon gear 32 is coupled to an upper end portion of the ribbon spool 56 so that the ribbon gear 32 rotates integrally with the ribbon spool 56 when the tube 9 is transported by the drive of a drive motor 103 (see FIG. 4 described later) that is a pulse motor.

A spool gear 33 meshed with the ribbon gear 32 is disposed rotatably within the ribbon cassette 95. The spool gear 33 is of a substantially cylindrical shape and has on its upper end periphery a plurality of teeth meshing with the ribbon gear 32. In this instance, the spool gear 33 has an addendum circle diameter smaller than that of the ribbon gear 32 (see FIG. 2). When viewed in a planar view, the spool gear 33 lies toward a wall surface of the ribbon cassette 95 with respect to a line joining a center of the ribbon spool 56 and a center of the ribbon take-up shaft 63 and has a dedendum circle and a rotation center that lie within a gap region defined by an outer circumference circle of the ribbon roll R1 at the start of use, an outer circumference circle of the ink ribbon 93 at the completion of use, and the inner side wall surface of the ribbon cassette 95. On the other hand, the addendum circle diameter of the ribbon gear 32 is greater than or equal to a roll diameter of the ribbon roll R1 at the start of use.

The ribbon gear 32 is considerably larger in diameter than the spool gear 33 due to such a positional relationship, with the result that the two gears 32, 33 have a large gear ratio therebetween. In this embodiment, the ratio of number of teeth between the ribbon gear 32 and the spool gear 33 is 50:16 for example. Therefore, when the ink ribbon 93 is transported by the drive of the drive motor 103, the spool gear 33 rotates at a high rotational speed that is a few times (e.g. approx. 3 times) faster than the rotational speed of the ribbon gear 32. The spool gear 33 has an uneven portion on an upper inner wall so as to engage with a cam member 76 that will be described later.

On the other hand, a rotation shaft 35 is disposed on the ribbon cassette mounting part 30. As shown in FIG. 3A, the rotation shaft 35 extends vertically from a base plate 65 positioned below a bottom plate 47 of the ribbon cassette mounting part 30, in the vicinity of a front side surface (a front left portion in FIG. 2) of the ribbon cassette mounting part 30. The cam member 76 of a cylindrical shape is mounted on the rotation shaft 35 in such a manner as to be rotatable around the rotation shaft 35. When the ribbon cassette 95 is mounted on the ribbon cassette mounting part 30, three vane-shaped protrusions disposed on an outer side surface of the cam member 76 fit into the uneven portion on the inner wall of the spool gear 33, allowing the cam member 76 to engage with the spool gear 33. Between the bottom plate 47 and the base plate 65 of the ribbon cassette mounting part 30, a disc-shaped encoder plate 25 (see FIG. 3B) is coupled to a lower end portion of the cam member 76 around the rotation shaft 35. Thus, when the ink ribbon 93 is withdrawn from the ribbon roll R1 by the drive of the drive motor 103 with the ribbon cassette 95 being mounted on the ribbon cassette mounting part 30, the encoder plate 25 is allowed to rotate at a high rotational speed that is a few times (approx. 3 times in this example) faster than the rotational speed of the ribbon gear 32, integrally with the spool gear 33 and the cam member 76.

The encoder plate 25 has an outer diameter greater than the addendum circle diameter of the spool gear 33. Due to its disposition below the bottom surface of the ribbon cassette mounting part 30 outside the ribbon cassette 95, the encoder plate 25 with a considerably large diameter can be disposed so that a plurality of (32 in the shown example) slits S can be arranged at predetermined intervals along the circumferential direction of the encoder plate 25 (see FIG. 3B). Portions between adjacent slits S function as shielding portions W not transmitting light. These M slits S and M shielding portions W function as detected elements (hereinafter, referred to appropriately as detected elements S, W) that are optically detected by a photosensor 26 described later. Hence, the encoder plate 25 has M (M is an integer greater than or equal to 2: M=64 in this example) detected elements S, W, which is double the number of slits.

The photosensor 26 in the form of e.g. a light transmission sensor is disposed in a position facing the slits S and the shielding portions W of the encoder plate 25. Although not shown, the photosensor 26 is fixedly secured to the base plate 65 and comprises a light emitting part 26*a* and a light receiving part 26*b* (see FIG. 9 described later). As will be described later, the photosensor 26 is connected to an input/output interface (I/F) 195 of a control circuit 190 (see FIG. 4 described later) so as to output a pulse signal (detection pulse) as a detection signal corresponding to each slit S and each shielding portion W when the encoder plate 25 rotates (see FIGS. 5A and 5B described later).

Referring back to FIG. 2, the tube mounting part 40 is a part to which the tube 9 is removably attached. The tube mounting part 40 is a groove portion that opens upward and extends from the tube insertion port 15 to the tube discharge port 16. Since the tube discharge port 16 is positioned slightly frontward of the tube insertion port 15, the tube mounting part 40 extends subsequently transversely with a slight left-frontward tilt. The ribbon cassette mounting part 30 has a rear end portion linked spatially with the tube mounting part 40 on the right side of the tube discharge port 16. The tube mounting part 40 has a groove width slightly greater than the outer diameter of tube 9, except a portion where the tube mounting part 40 is linked spatially with the ribbon cassette mounting part 30. The user can mount the tube 9 on the tube mounting part 40 from above while the cover 12 is opened. At that time, the user mounts the tube 9 on the tube mounting part 40 such that the tube 9 extends from the tube insertion port 15 to a predetermined press-bonding position. When mounted on the tube mounting part 40, the tube 9 is transported through a tube transport path 40*a* (hereinafter, appropriately, referred to simply as "transport path 40*a*") along the tube mounting part 40 by a platen roller 62 and pressure feeding rollers 66 and 67 that will be described later. Hereinafter, the direction of extension of the transport path 40*a* is referred to as a tube transport direction (hereinafter, appropriately, referred to simply as "transport direction").

The printer 1 comprises a control substrate 19, a power supply part 18 (see FIG. 4 described later), and a tube printing mechanism 60.

The control substrate 19 is a substrate having a control circuit 190 described later (see FIG. 4 described later). In this example, the control substrate 19 is disposed in a right rear portion within the interior of the body case 11.

The tube printing mechanism 60 includes a printing head 61, the platen roller 62, a pair of the pressure feeding rollers 66, a pair of the pressure feeding rollers 67, the ribbon take-up shaft 63, the drive motor 103 (see FIG. 4 described later), a cutter 64, a blade receiving plate 65, and a cutter motor 105 (see FIG. 4 described later). Hereinafter, the platen roller 62 and the pressure feeding rollers 66 and 67 are appropriately referred to collectively as "platen roller 62, etc.".

The printing head 61 and the ribbon take-up shaft 63 extend vertically upward from the bottom surface of the ribbon cassette mounting part 30. The printing head 61 is a thermal head having a plurality of heat generating elements (not shown), disposed in a rear portion of the ribbon cassette mounting part 30. Using the ink ribbon 93, the printing head 61 forms print on the tube 9 transported by the platen roller 62, etc. and clamped between the printing head 61 and the platen roller 62. The ribbon take-up shaft 63 is a shaft capable of rotating a ribbon take-up spool 92. When the ribbon cassette 95 is mounted on the ribbon cassette mounting part 30, the ribbon take-up shaft 63 fits in the ribbon take-up spool 92.

On the rear side of the ribbon cassette mounting part 30, the platen roller 62 is arranged facing the printing head 61 along a direction orthogonal to the transport direction. The platen roller 62 superimposes the tube 9 lying within the tube mounting part 40 and an unused ink ribbon of the ribbon cassette 95 that are clamped between the platen roller 62 and the printing head 61, to press the tube 9 and the unused ink ribbon toward the printing head 61, and transports the tube 9 along the transport path 40*a* while flattening the tube 9 and bringing the tube 9 into surface contact with the printing head 61 by way of the ink ribbon 93. The pair of pressure feeding rollers 66 are arranged facing each other along a direction orthogonal to the transport direction, toward the tube insertion port 15 (hereinafter, appropriately referred to simply as "upstream") along the transport path 40*a* with respect to the printing head 61. The pair of pressure feeding rollers 66 transport the clamped tube 9 within the tube mounting part 40 along the transport path 40*a* while press-bonding and flattening the tube 9. The pair of pressure feeding rollers 67 are arranged facing each other along a direction orthogonal to the transport direction, upstream of an optical sensor 69 (see FIG. 4 described later) and toward the tube discharge port 16 (hereinafter, appropriately referred to simply as "downstream") along the transport path 40*a* by a predetermined distance from the printing head 61. The pair of pressure feeding rollers 67 transport the clamped tube 9 within the tube mounting part 40 along the transport path 40*a* while press-bonding and flattening the tube 9.

The platen roller 62, the pressure feeding roller 66 on one hand, and the pressure feeding roller 67 on one hand are displaceable between their respective operating positions and retracted positions in response to opening and closing of the cover 12. When the cover 12 is opened, the platen roller 62, the pressure feeding roller 66 on one hand, and the pressure feeding roller 67 on one hand are displaced to their respective retracted positions. In the case (not shown) that the platen roller 62, the pressure feeding roller 66 on one hand, and the pressure feeding roller 67 on one hand are at their respective retracted positions, the platen roller 62, the pressure feeding roller 66 on one hand, and the pressure feeding roller 67 on one hand are positioned outside of the tube mounting part 40 so as to be separated from the printing head 6, the pressure feeding roller 66 on the other, and the pressure feeding roller 67 on the other, respectively. On the other hand, when the cover 12 is closed, the platen roller 62, the pressure feeding roller 66 on one hand, and the pressure feeding roller 67 on one hand are displaced to their respective operating positions. In the case (see FIG. 2) that the platen roller 62, the pressure feeding roller 66 on one hand, and the pressure feeding roller 67 on one hand are at their respective operating positions, the platen roller 62, the pressure feeding roller 66 on one hand, and the pressure feeding roller 67 on one hand are positioned inside of the tube mounting part 40 so as to come closer to the printing head 61, the pressure feeding roller 66 on the other, and the pressure feeding roller 67 on the other, respectively.

The drive motor 103 outputs a driving force for rotating the platen roller 62, the pressure feeding rollers 66, the pressure feeding rollers 67, and the ribbon take-up shaft 63. The driving force of the drive motor 103 is transmitted via a predetermined transmission mechanism to the platen roller 62, the pressure feeding rollers 66, the pressure feeding rollers 67, and the ribbon take-up shaft 63 so that the platen roller 62, the pressure feeding rollers 66, the pressure feeding rollers 67, and the ribbon take-up shaft 63 can rotate in synchronism with one another.

The cutter 64 and the blade receiving plate 65 are arranged facing each other on opposite sides of the transport path 40*a*, downstream of the printing head 61. The cutter 64 moves toward the blade receiving plate 65 to press and cut the tube 9 within the tube mounting part 40 against the blade receiving plate 65, to separate a portion of the tube lying downstream of the cutting position.

The cutter motor 105 outputs a driving force for activating the cutter 64.

A mechanical sensor 68 is disposed on the transport path 40*a* upstream of the pressure feeding rollers 66. The mechanical sensor 68 performs a mechanical detection of whether the tube 9 is present or absent, to output a corresponding detection signal. For example, the mechanical sensor 68 detects the presence of the tube 9 when a retractable detected element extending vertically on the transport path 40*a* falls down, to output a detection signal.

The optical sensor 69 is disposed downstream of the pressure feeding roller 67 and upstream of the cutter 64 within the body case 11. The optical sensor 69 is a transmission type optical sensor having e.g. a light projecting part 691 and a light receiving part 692 (see FIG. 4 described later).

<Control System>

Referring next to FIG. 4, a control system of the printer 1 will be described.

In FIG. 4, as described above, the control substrate 19 of the printer 1 comprises the control circuit 190. The control circuit 190 includes a CPU 191 functioning as a processor, which is connected via a data bus to a ROM 192, a memory 193, a RAM 194, and an I/O interface 195.

The ROM 192 stores various programs (including a control program executing process steps of a flowchart shown in FIG. 8 described later) required for control of the printer 1. The CPU 191 executes signal processing in accordance with a program stored in the ROM 192 while utilizing a temporary storage function of the RAM 194, to thereby perform overall control of the printer 1.

The I/O interface 195 connects to drive circuits 101, 102, 104, the operation part 17, the power supply part 18, the photosensor 26, the mechanical sensor 68, the light projecting part 691 and the light receiving part 692 of the optical sensor 69, etc.

The drive circuit 101 performs energization control of the plurality of heat generating elements of the printing head 61. The drive circuit 102 outputs a drive pulse to the drive motor 103 rotating the platen roller 62, the ribbon take-up shaft 63, and the pressure feeding rollers 66, 67, to thereby perform drive control. The drive circuit 104 performs drive control of the cutter motor 105 driving the cutter 64.

The power supply part 18 is connected to a battery (not shown) mounted in the body case 11 or is connected via a cord to an external power source (not shown), to supply power to the printer 1.

<Schematic Printed Tube Producing Action>

In the thus configured printer 1, when the cover 12 is closed and the platen roller 62, the pressure feeding roller 66 on one hand, and the pressure feeding roller 67 on one hand are displaced from their respective retracted positions to their respective operating positions after the mounting of the ribbon cassette 95 on the ribbon cassette mounting part 30 and mounting of the tube 9 on the tube mounting part 40, the tube 9 and the ink ribbon 93 are clamped between the printing head 61 and the platen roller 62 while the tube 9 is clamped between the pair of pressure feeding rollers 66 and between the pair of pressure feeding rollers 67.

Due to the driving force of the drive motor 103, the platen roller 62, the pressure feeding rollers 66, the pressure feeding rollers 67, and the ribbon take-up shaft 63 rotate in synchronism with one another. The tube 9 is transported to the downstream side with rotation of the platen roller 62, the pressure feeding rollers 66, and the pressure feeding rollers 67 and the ribbon take-up spool 92 rotates with rotation of the ribbon take-up shaft 63, allowing the ink ribbon 93 to be withdrawn from the ribbon roller R1. At that time, the plurality of heat generating elements of the printing head 61 are supplied with power from the drive circuit 101 to generate heat and the front surface of the tube 9 is brought into surface contact with the printing head 61 by way of the ink ribbon 93. As a result, the printing head 61 performs printing of print data such as letters, symbols, and graphics on the front surface of the tube 9. The used ink ribbon 93 is taken up around the ribbon take-up spool 92.

Afterward, the tube 9 is transported further downstream and is discharged from the housing 10 by way of the tube discharge port 16. At that time, when a cut position of the tube 9 is fed to the cutting position, the cutter 64 is actuated by the driving force of the cutter motor 105 so that the tube 9 is cut off at its cut position, allowing a portion of the tube on which print data is formed, lying downstream of the cut position to be separated as a printed tube.

<Feature of This Embodiment>

This embodiment is featured by a technique of detecting a consumption completion status of the ink ribbon 93 promptly and with high accuracy by use of a pulse index value (that will be described later). Details thereof will hereinafter be described.

<Optical Detection of Encoder Plate>

As described above, when executing print on the tube 9, the drive motor 103 in the form of the pulse motor drives the ribbon take-up shaft 63 on the basis of a drive pulse from the drive circuit 102 so that the ink ribbon 93 wound into the ribbon roll R1 is fed out from the ribbon roll R1 and transported. At that time, due to the above configuration, the encoder plate 25 rotates in conjunction with rotation of the ribbon roll R1 caused by the transport of the ink ribbon 93.

In the example shown in FIG. 5A, in the conjunction of the drive of the drive motor 103 and the rotation of the encoder plate 25 as described above, one slit S is detected by the photosensor 26 due to rotation of the encoder plate 25 for the duration of output of 5 drive pulses (denoted as "drive motor pulse" in the diagram), and one shielding portion W is detected by the photosensor 26 due to rotation of the encoder plate 25 for the duration of output of 4 drive pulses. Therefore, when detected elements S and W are viewed as a whole, one detected element S, W is detected by the photosensor 26 for the duration of output of 4.5 drive pulses.

On the other hand, according as the ink ribbon 93 is consumed, the ribbon roll R1 has a smaller diameter, resulting in a higher angular velocity of the encoder plate 25 rotated by the transport. Hence, consumption of the ink ribbon 93 advances from the state shown in FIG. 5A, one detected element S, W is detected by the photosensor 26 for the duration of output of 3 drive pulses for example.

In this embodiment, attention is paid to the above relationship to perform processes using a pulse count (hereinafter, appropriately, referred to as "pulse count index value) of drive pulses per detected element S, W as an index value for detecting a consumption completion status (so-called tape end) of the ink ribbon 93 fed out and transported as described above. In the example of FIG. 5A for instance, the pulse index value is 4.5. As described above, with advancement of consumption of the ink ribbon 93, this pulse index value decreases gradually.

When the ink ribbon 93 reaches the consumption completion status as a result of further advancement in consumption of the ink ribbon 93, the encoder plate 25 does not rotate in spite of the drive of the drive motor 103 (the next detected element S, W does not appear irrespective of the number of pulses output), as shown in FIG. 5B, whereupon the pulse index value P increases to an extreme extent. Based on such a behavior, if the detected element S, W is not detected regardless of output of predetermined number of drive pulses (14 pulses in the example of FIG. 5B), the consumption completion status may possibly be detected from that fact.

<Calculation Content>

In this embodiment, however, to detect the consumption completion status more promptly and with higher accuracy, the CPU 191 executes further in-depth calculation processing. The content of the processing will be described separately in two states, i.e. a state immediately after the start of transport (in more detail, duration of one turn of the encoder plate 25 after the start of rotation) and a state after elapse of a certain time from the start of transport (in more detail, after one turn of the encoder plate 25). Hereinafter, in an example described using FIGS. 6 and 7, for simplicity of explanation, a case will be described, as a schematic example, where the encoder plate 25 has only 10 detected elements S, W (5slits S and 5 shielding portions W, i.e. M=5). The above "after the start of transport" includes not only a case where a new ribbon cassette 95 is mounted to transport an unused ink ribbon 93 for starting to use, but also a case where the ribbon cassette 95 whose use has already been started is mounted to newly perform print on the tube 9. That is, it is equivalent in meaning to "after the start of print processing".

<Until Encoder Plate Achieves One Turn of Rotation>

In this embodiment, as described above, after the start of transport, the pulse index value P is calculated in sequence each time the detected element S, W is detected so that the consumption completion status is determined based on the behavior of the values. Specifically, a determination target value is a sum of a latest pulse index value P and a second latest pulse index value P and is compared with a comparison value (a mean value of all past pulse count index value data calculated so far).

For example, when a first detected element S, W is first detected immediately after the start of transport, a corresponding pulse index value P1 (hereinafter, a pulse index value corresponding to an N-th detected element S, W is denoted as PN (N is an integer greater than or equal to 1) in this manner) is calculated (see FIG. 6A). Since the comparison value for comparison is not yet present at this stage, the determination based on the comparison is not performed (see FIG. 6B).

Subsequently, when a second detected element S, W is detected and a corresponding pulse index value P2 is calculated (see FIG. 6A), P1+P2 that is a sum of the one-precedent pulse index value P1 and the current pulse index value P2 becomes a determination target value X1. Since the comparison value for meaningful comparison is not yet present in this case as well (because the calculated pulse count index values are only P1 and P2, comparison with a mean value thereof is meaningless), the determination based on the comparison is not performed (see FIG. 6B).

Subsequently, when a third detected element S, W is detected and a corresponding pulse index value P3 is figured out (see FIG. 6A), a determination target value X2 is P2+P3 that is a sum of the one-precedent pulse index value P2 and the current pulse index value P3. In this case, the comparison value Y1 is expressed as Y1=average (y1) that is a mean value of the precedent pulse count index values P1 and P2, i.e. a value obtained by dividing a sum y1=P1+P2 by 2. In view of the behavior that the pulse index value P increases to an extreme extent when the consumption completion status is achieved as described above, the determination of the consumption completion status is performed based on whether X2/(Y1×2) that is a ratio of X2 to the double of Y1 is greater than a previously defined threshold value α (denoted as "end determination formula" in FIG. 6B). This threshold value α is fixedly set to a value (1.6 in this example) that is greater to some extent than 1 for example. Although fixedly set during the arithmetic processing (for across-the-board application), the value itself may variably be set by a proper command before the start of the arithmetic processing.

Subsequently, similarly, when a fourth detected element S, W is detected and a corresponding pulse index value P4 is figured out (see FIG. 6A), a determination target value X3 is P3+P4 that is a sum of the one-precedent pulse index value P3 and the current pulse index value P4. In this case, similar to the pulse count index value P3 corresponding to the third detected element S, W, the comparison value is Y1=average (y1) that is the mean value of the pulse count index values P1 and P2. Accordingly, using this mean value, the determination of the consumption completion status is performed based on whether X3/(Y1×2) that is a ratio of X3 to the double of Y1 is greater than the threshold value α (see FIG. 6B).

Subsequently, similarly, when a fifth detected element S, W is detected and a corresponding pulse index value P5 is figured out (see FIG. 6A), a determination target value X4 is P4+P5 that is a sum of the one-precedent pulse index value P4 and the current pulse index value P5. In this case, the comparison value is Y2=average (y2) that is a mean value of all the precedent pulse count index values P1, P2, P3, and P4, i.e. a value obtained by dividing a sum y2 of P1+P2+P3+P4 by 4. Using this mean value, the determination of the consumption completion status is performed based on whether X4/(Y2×2) that is a ratio of X4 to the double of Y2 is greater than the threshold value α (see FIG. 6B).

Subsequently, similarly, when a sixth detected element S, W is detected and a corresponding pulse index value P6 is figured out (see FIG. 6A), a determination target value X5 is P5+P6 that is a sum of the one-precedent pulse index value P5 and the current pulse index value P6. In this case, similar to the pulse count index value P5 corresponding to the fifth detected element S, W, the comparison value is Y2=average (y2) that is a mean value of the pulse count index values P1, P2, P3, and P4. Accordingly, using this mean value, the determination of the consumption completion status is performed based on whether X5/(Y2×2) that is a ratio of X5 to the double of Y2 is greater than the threshold value α (see FIG. 6B).

Subsequently, similarly, when a seventh detected element S, W is detected and a corresponding pulse index value P7 is figured out (see FIG. 6A), a determination target value X6 is P6+P7 that is a sum of the one-precedent pulse index value P6 and the current pulse index value P7. In this case, the comparison value is Y3=average (y3) that is a mean value of all the precedent pulse count index values P1, P2, P3, P4, P5, and P6, i.e. a value obtained by dividing a sum y3 of P1+P2+P3+P4+P5+P6 by 6. Using this mean value, the determination of the consumption completion status is performed based on whether X6/(Y3×2) that is a ratio of X6 to the double of Y3 is greater than the threshold value α (see FIG. 6B).

Subsequently, similarly, when an eighth detected element S, W is detected and a corresponding pulse index value P8 is figured out (see FIG. 6A), a determination target value X7 is P7+P8 that is a sum of the one-precedent pulse index value P7 and the current pulse index value P8. In this case, similar to the pulse count index value P7 corresponding to the seventh detected element S, W, the comparison value is Y3=average (y3) that is a mean value of the pulse count index values P1, P2, P3, P4, P5, and P6. Accordingly, using this mean value, the determination of the consumption completion status is performed based on whether X7/(Y3×2) that is a ratio of X7 to the double of Y3 is greater than the threshold value α (see FIG. 6B).

Subsequently, similarly, when a ninth detected element S, W is detected and a corresponding pulse index value P9 is figured out (see FIG. 6A), a determination target value X8 is P8+P9 that is a sum of the one-precedent pulse index value P8 and the current pulse index value P9. In this case, the comparison value is Y4=average (y4) that is a mean value of all the precedent pulse count index values P1, P2, P3, P4, P5, P6, P7, and P8, i.e. a value obtained by dividing a sum y4 of P1+P2+P3+P4+P5+P6+P7+P8 by 8. Using this mean value, the determination of the consumption completion status is performed based on whether X8/(Y4×2) that is a ratio of X8 to the double of Y4 is greater than the threshold value α (see FIG. 6B).

Subsequently, similarly, when a tenth detected element S, W is detected and a corresponding pulse index value P10 is figured out (see FIG. 6A), a determination target value X9 is P9+P10 that is a sum of the one-precedent pulse index value P9 and the current pulse index value P10. In this case, similar to the pulse count index value P9 corresponding to the ninth detected element S, W, the comparison value is Y4=average (y4) that is a mean value of the pulse count index values P1, P2, P3, P4, P5, P6, P7, and P8. Accordingly, using this mean value, the determination of the consumption completion status is performed based on whether X9/(Y4×2) that is a ratio of X9 to the double of Y4 is greater than the threshold value α (see FIG. 6B).

An ordinal number k in FIG. 6B will be described later.

<After Encoder Plate Exceeds One Turn of Rotation>

In this embodiment, after one turn of rotation of the encoder plate 25, similar to the above, a sum of a latest pulse index value P and a second latest pulse count index value P is used as the determination target value, which in turn is compared with a comparison value (a mean value of a predetermined range of pulse count index value data calculated so far, in this example, 10 pulse count index value data just for one turn of the encoder plate 25).

For example, when a $109^{th}$ detected element S, W is detected in the process of eleventh turn after the completion of 10 turns of rotation of the encoder plate 25 and a corresponding pulse index value P109 is figured out (see FIG. 7A), a determination target value X108 is P108+P109 that is a sum of the one-precedent pulse index value P108 and the current pulse index value P109. In this case, the comparison value is Y54=average (y'54) that is a value obtained by dividing a sum y' of most recent 10 pulse count index values P99, P100, P101, P102, P103, P104, P105, P106, P107, and P108 by 10. Using this mean value, the determination of the consumption completion status is performed based on whether X108/(Y54×2) that is a ratio of X108 to the double of Y54 is greater than the threshold value α (see FIG. 76B).

Subsequently, in the same manner, when a $110^{th}$ detected element S, W is detected and a corresponding pulse index value P110 is figured out (see FIG. 7A), a determination target value X109 is P109+P110 that is a sum of the one-precedent pulse index value P109 and the current pulse index value P110. In this case, similar to the pulse count index value P109 corresponding to the $109^{th}$ detected element S, W, the comparison value is Y54=average (y'54) that is a mean value of the pulse count index values P99 to P108. Accordingly, using this mean value, the determination of the consumption completion status is performed based on whether X109/(Y54×2) that is a ratio of X109 to the double of Y54 is greater than the threshold value α (see FIG. 7B).

In the same manner, when a $111^{th}$ detected element S, W is detected, a determination target value X110 is P110+P111 that is a sum of the pulse index values P and the comparison value is Y55=average (y'55) that is a mean value obtained by dividing a sum y'55 (P101+ . . . +P110) of most recent 10 pulse count index values P by 10. The determination is then performed based on whether X110/(Y55×2) is greater than the threshold value α (see FIG. 7B). When a $112^{th}$ detected element S, W is detected, a determination target value X111 is P111+P112 that is a sum of the pulse index values P and the comparison value is Y55=average (y'55). The determination is then performed based on whether X111/(Y55×2) is greater than the threshold value α (see FIG. 7B).

In the same manner, when a $113^{th}$ detected element S, W is detected, a determination target value X112 is P112+P113 that is a sum of the pulse index values P and the comparison value is Y56=average (y'56) that is a mean value obtained by dividing a sum y'56 (P103+ . . . +P112) of most recent 10 pulse count index values P by 10. The determination is then performed based on whether X112/(Y56×2) is greater than the threshold value α (see FIG. 7B). When a $114^{th}$ detected element S, W is detected, a determination target value X113 is P113+P114 that is a sum of the pulse index values P and the comparison value is Y56=average (y'56). The determination is then performed based on whether X113/(Y56×2) is greater than the threshold value α (see FIG. 7B).

In the same manner, when a $115^{th}$ detected element S, W is detected, a determination target value X114 is P114+P115 that is a sum of the pulse index values P and the comparison value is Y57=average (y'57) that is a mean value obtained by dividing a sum y'57 (P105+ . . . +P114) of most recent 10 pulse count index values P by 10. The determination is then performed based on whether X114/(Y57×2) is greater than the threshold value α (see FIG. 7B). When a $114^{th}$ detected element S, W is detected, a determination target value X113 is P113+P114 that is a sum of the pulse index values P and the comparison value is Y56=average (y'56). The determination is then performed based on whether X113/(Y56×2) is greater than the threshold value α (see FIG. 7B).

Hereafter, each time a latest detected element S, W is detected, the processing technique similar to the above is repeated.

Similar to the above, the ordinal number k in FIG. 7B will be described later.

<Control Procedure>

Referring next to FIG. 8, description will be given of a control procedure executed by the CPU 191 of the printer 1 in order to implement the above technique.

In FIG. 8, processing shown in this flowchart is started in response to execution of a predetermined operation (e.g. an operation for instruction to start print) after the printer 1 is powered.

First, at step S10, the CPU 191 determines whether transport of the ink ribbon 93 is started by the drive of the platen roller 62 and the ribbon take-up shaft 63 by the drive motor 103. If negative, this determination is not satisfied (S10: NO), resulting in loop wait until it is satisfied. If affirmative, this determination is satisfied (S10: YES), allowing the procedure to go to step S15. As described above, the encoder plate 25 starts to rotate in conjunction with the start of transport so that the photosensor 26 starts to detect each detected element S, W of the encoder plate 25 in rotation.

At step S15, the CPU 191 acquires the total number M (M=64 in the example shown in FIG. 3B) of the detected elements S, W disposed on the encoder plate 25, stored in advance on a proper site (e.g. the ROM 192).

At step S20, the CPU 191 sets the value of a variable N to N=0. Subsequently, the procedure goes to step S25.

At step S25, it is determined whether the photosensor 26 has detected an $(N+1)^{th}$ detected element (initially, since N=0, a first detected element) S, W on the encoder plate 25, in other words, whether a detection pulse (see FIG. 5A, etc. described above) corresponding to the detected element S, W has been input via the I/O interface 195 from the photosensor 26. The determination is not satisfied (step S25: NO) until the $(N+1)^{th}$ detected element S, W is detected, resulting in loop wait, and if the $(N+1)^{th}$ detected element S, W is detected, the determination is satisfied (step S25: YES), allowing the procedure to shift to step S30.

At step S30, the CPU 191 calculates an $(N+1)^{th}$ (initially, since N=0, a first) pulse index value $P_{N+1}$, based on the result of detection at step S25 (see also FIGS. 6 and 7). The procedure then goes to step S32.

At step S32, the CPU 191 determines whether the value of N is greater than or equal to 1 at that point of time. If N<1 (i.e. N=0), the determination is not satisfied (step S32: NO), the procedure returns to step S25 after addition of 1 to N at step S33, repeating similar steps. If N≥1, the determination is satisfied (step S32: YES), allowing the procedure to shift to step S35.

At step S35, the CPU 191 calculates a determination target value $X_N=P_{N+1}+P_N$ from an $(N+1)^{th}$ pulse count index value $P_{N+1}$ calculated at step S30 and a preceding $N^{th}$ pulse count index value $P_N$ (already figured out at step S30 before returning to step S25 via step S33 from step S32).

Subsequently, at step S40, the CPU 191 determines whether the value of N at that point of time is less than or equal to the value of M acquired at step S15 (N≤M). If N>M, this determination is not satisfied (S40: NO), allowing the procedure to shift to step S50 described later, whereas if N≤M, this determination is satisfied (S40: YES), allowing a shift to step S45.

At step S45, the CPU 191 determines whether N is an odd number. If negative (i.e. it is an even number), this determination is not satisfied (S45: NO), allowing a shift to step S60 described later. If affirmative, this determination is satisfied (S45: YES), allowing a shift to step S55.

At step S55, the CPU 191 determines a natural number k meeting N=2k−1, thereafter shifting to step S75.

At step S75, the CPU 191 determines whether N is greater than or equal to 3 (N≥3). If N is less than 3, this determination is not satisfied (S75: NO), allowing a shift to step S140, whereas if N is greater than or equal to 3, this determination is satisfied (S75: YES), allowing a shift to step S85.

At step S85, the CPU 191 figures out a mean value $Y_{k-1}$ (see FIG. 6) of P1 to $P_{N-1}$ in accordance with the result of calculation at step S30 up to that point of time, thereafter shifting to step S105.

On the other hand, at step S60 to which the procedure has shifted as a result of non-satisfaction in the determination at step S45, the CPU 191 determines a natural number k meeting N=2k, thereafter shifting to step S80.

At step S80, the CPU 191 determines whether N is greater than or equal to 4 (N≥4). If negative, this determination is not satisfied (S80: NO), allowing a shift to step S140 described later, whereas if affirmative, this determination is satisfied (S80: YES), allowing a shift to step S90.

At step S90, the CPU 191 figures out a mean value $Y_{k-1}$ (see FIG. 6) of P1 to $P_{N-2}$ in accordance with the result of calculation at step S30 up to that point of time, thereafter shifting to step S105.

At step S105, the CPU 191 figures out a value of $X_{N-1}/2Y_{k-1}$ for determination of the consumption completion status of the ink ribbon 93, in accordance with the result of calculation at step S35 up to that point of time and the result of calculation at step S85 or S90.

Subsequently, at step S120, the CPU 191 determines whether the value of $X_{N-1}/2Y_{k-1}$ figured out at step S105 is greater than the threshold value α. If negative, this determination is not satisfied (S120: NO), allowing a shift to step S140 described later. If affirmative, this determination is satisfied (S120: YES), allowing a shift to step S130.

At step S130, the CPU 191 executes a predetermined tape end process (e.g. a proper informing process such as a predetermined alarm display or stop of transport of the ink ribbon 93), to end this flow.

On the other hand, at step S50 to which the procedure has shifted as a result of non-satisfaction in the determination at step S40, in the same manner as in step S45, the CPU 191 determines whether N is an odd number. If negative (i.e. it is an even number), this determination is not satisfied (S50: NO), allowing a shift to step S70 described later. If affirmative, this determination is satisfied (S50: YES), allowing a shift to step S65.

At step S65, in the same manner as in step S55, the CPU 191 determines a natural number k meeting N=2k−1, thereafter shifting to step S95.

At step S95, the CPU 191 figures out a mean value $Y_{k-1}$ (see FIG. 7) of $P_{N-M}$ to $P_{N-1}$ in accordance with the result of calculation at step S30 up to that point of time, thereafter shifting to step S110 described later.

On the other hand, at step S70 to which the procedure has shifted as a result of non-satisfaction in the determination at step S50, in the same manner as in step S60, the CPU 191 determines a natural number k meeting N=2k, thereafter shifting to step S100.

At step S100, the CPU 191 figures out a mean value $Y_{k-1}$ (see FIG. 7) of $P_{N-M-1}$ to $P_{N-2}$ in accordance with the result of calculation at step S30 up to that point of time, thereafter shifting to step S110.

At step S110, the CPU 191 figures out a value of $X_{N-1}/2Y_{k-1}$ for determination of the consumption completion status of the ink ribbon 93, in accordance with the result of calculation at step S35 up to this point of time and the result of calculation at step S95 or S100, thereafter shifting to step S125 described later.

At step S125, the CPU 191 determines whether the value of $X_{N-1}/2Y_{k-1}$ calculated at step S110 or the value of $X_{N-1}/2Y_k$ calculated at step S115 is greater than the threshold value α. If negative, this determination is not satisfied (S125: NO), allowing a shift to step S140 described later. If affirmative, this determination is satisfied (S125: YES), allowing a shift to step S135.

At step S135, in the same manner as in step S130, the CPU 191 executes a predetermined tape end process (e.g. a proper informing process such as a predetermined alarm display or stop of transport of the ink ribbon 93), to end this flow.

On the other hand, at step S140 to which the procedure has shifted as a result of non-satisfaction in the determination at steps S75, S120, S80, and S125, it is determined whether transport of the ink ribbon 93 started at step S10 has terminated. If negative, this determination is not satisfied (S140: NO), and 1 is added to the value of N at step S145, after which the procedure goes back to step S25 for repetition of similar processes. If affirmative, the determination at step S140 is satisfied (S140: YES), bringing this flow to an end.

<Advantages of the Embodiment>

In this embodiment, as has been described hereinabove, first at step S35, the CPU 191 figures out the determination target value $X_N=P_N+P_{N+1}$ from the N-th pulse count index value $P_N$ and the $(N+1)^{th}$ pulse count index value $P_{N+1}$ adjoining thereto. This has significance which follows. In the case that the optical detection is applied to the encoder plate 25 as above, both the slits of the encoder plate 25 and the shielding portions W between the slits S act as the detected elements. In this case, the optical detection by the photosensor 26 allows detection of a convex pulse from the slit S and detection of a concave pulse from the shielding portion W for example (see also the example of FIG. 5). At that time, if the width dimension of the slit S on the encoder plate 25 is equal to that of the shielding portion W thereon, the duration of the convex pulse detected by the photosensor 26 should originally be equal to that of the concave pulse detected thereby.

Nevertheless, actually, as shown in FIG. 9, time during which light from the photosensor 26 passes through the slits S becomes larger in proportion than time during which the light is shielded by the shielding portions W, due to the influence of spread (diffusion) of light when passing through the slits S. As a result, the duration of the convex pulse and the duration of the concave pulse to be originally the same may not become equal to each other.

As shown in FIG. 10, the same may occur from the magnitude relation between the threshold value set at the time of optical detection and signal value. Specifically, in the case that "high" signal is partitioned from "low" signal by a threshold value 1, the duration of the convex pulse becomes subsequently equal to that of the concave pulse, whereas in the case of partitioning the signal into "high" and "low" by a threshold value 2, the duration (i.e. "high" output duration) of the convex pulse becomes shorter than the duration (i.e. "low" output time) of the concave pulse.

Regardless of occurrence of the above influences, however, the total duration of one convex pulse and one concave pulse is unvaried that is expressed as duration to (see FIG. 5A) from detection of a rising edge of the convex pulse from one slit S to detection of a next rising edge or as duration tB (see FIG. 5A) from detection of a falling edge of the convex pulse from one shielding portion W to detection of a next falling edge. Paying attention to this fact, in this embodiment, the determination target value $X_N$ is figured out from the N-th pulse count index value $P_N$ (corresponding to either one of the convex pulse and the concave pulse) and the adjoining $(N+1)^{th}$ pulse count index value $P_{N+1}$ (corresponding to remaining one of the convex pulse and the concave pulse) as described above (see step S35 of FIG. 8). This enables concerns over the optical detection to be obviated, achieving high accuracy.

In this embodiment, the CPU 191 calculates mean value $Y_{k-1}$ or $Y_k$ of a plurality of consecutive pulse count index values P within a predetermined range at steps S85, S90, S95, and S100, and thereafter applies predetermined arithmetic operations to the determination target value $X_N$ and the mean value $Y_{k-1}$ or $Y_k$ at subsequent steps S105, S110, and S115, to figure out $X_{N-1}/2Y_{k-1}$ or $X_{N-1}/2Y_k$. The mean value $Y_{k-1}$ or $Y_k$ of the plurality of pulse count index values P as described above can be used as the past actual value having high reliability without any influence of variations and fluctuations of the pulse count index values P in the subsequent arithmetic operation for calculating $X_{N-1}/2Y_{k-1}$ or $X_{N-1}/2Y_k$.

In this embodiment, the CPU 191 performs the above arithmetic processing from moment to moment while incrementing N with the consumption of the ink ribbon 93, and determines whether the ink ribbon 93 has reached the consumption completion status in accordance with the magnitude relation between $X_{N-1}/2Y_{k-1}$ or $X_{N-1}/2Y_k$ calculated from moment to moment and the above threshold value $\alpha$. This enables the consumption completion status of the ink ribbon 93 to be detected more promptly and with higher accuracy than the technique of simply detecting an arrival at a termination definition pulse count of a pulse count value corresponding to the amount of transport of the ink ribbon 93 or than the technique of simply waiting non-detection of the detected element S, W at the time of output of a predetermined number of drive pulses as described above.

Particularly in this embodiment, as described earlier using FIG. 7, the processing is carried out using the pulse count index value P corresponding to the detected elements S, W for one turn of the encoder plate 25, esp. latest one turn thereof, thereby enabling a reliable and accurate detection of the consumption completion status.

Particularly in this embodiment, as described earlier using FIG. 6, the processing is carried out using the pulse count index value P corresponding to the detected elements S, W detected so far, even in the case where much time has not elapsed after the start of transport of the ink ribbon 93 and detected elements S, W for one turn of the encoder plate 25 have not yet been detected, thereby enabling a reliable detection of the consumption completion status.

Particularly, in this embodiment, as described using FIG. 6, particularly, duration of the unstable state of action immediately after the start of transport (in other words, immediately after the start of printing action) is excluded from the determination target (see the pulse index values P1 and P2 of FIG. 6B). This eliminates the adverse effect arising from the unstable state, to ensure a more reliable and accurate detection of the consumption completion status.

The present disclosure is not intended to be limited to the above embodiment and may variously be modified without departing from its spirit and technical idea. Such modification examples will hereinafter be described in due course.

(1) Case of Using Threshold Value $\beta$ Different from $\alpha$

For example, it may be determined whether the ink ribbon 93 has reached the consumption completion status, in accordance with comparison of magnitude between the value of the pulse index value P calculated at step S30 every time step S30 of FIG. 8 is executed and a different threshold value $\beta$ (e.g. a value of the order of 200) together with the magnitude comparison between $X_{N-1}/2Y_{k-1}$ (or $X_{N-1}/2Y_k$) and the threshold value $\alpha$. In this case, if, for example, $X_{N-1}/2Y_{k-1}$ (or $X_{N-1}/2Y_k$) becomes greater than $\beta$, the tape end process similar to step S130 or S135 is carried out.

According to this modification example, the consumption completion status is determined in accordance with the value itself of the latest pulse count index value P, using the threshold value $\beta$, in addition to the technique of determining the consumption completion status based on the magnitude comparison between $X_{N-1}/2Y_{k-1}$ (or $X_{N-1}/2Y_k$) and the threshold value $\alpha$, with the result that the consumption completion status of the ink ribbon 93 can be detected more reliably.

(2) Application to Medium Other than Ink Ribbon

Although in the above embodiment, description has been given of the case by way of example where the elongated medium whose consumption completion status is to be determined is a thermal transfer ribbon that performs a thermal transfer onto the tube 9 by heat from the printing head 61, this is not limitative. The elongated medium may be a print-receiving tape fed out and consumed, when print is executed, from a proper roll into which the tape is wound in advance. The above technique may be applied to such a print-receiving tape. Furthermore, the elongated medium may be a print-receiving tube like the tube 9 as long as it is fed out and consumed, when print is executed, from a proper roll into which the tube is wound in advance. The above technique may be applied to such a print-receiving tube.

(3) Exclusion of Durations Immediately Before and after Cutting

For example, in the case of using the print-receiving tape or the print-receiving tube as the elongated medium as described in (2), the tape or tube may be cut off by a cutter (the cutter 64 in this example) disposed within the printer so that it has a user's desired length after the formation of print by the printing head. This modification example deals with such a case and does not perform the determination related to the consumption completion status as described above for predetermined durations before and after the cutting action by the cutter, but performs the determination related to the consumption completion status at timings other than the predetermined durations.

Since in this embodiment, the unstable state of action at the time of cutting by the cutter is excluded from the determination target, the adverse effect arising from the unstable states can be eliminated and a more reliable and accurate detection of the consumption completion status is feasible.

(4) Others

In the case that "vertical", "parallel", "plane", etc. appear in the above description, those terms are not used in a strict sense. Those "vertical", "parallel", "plane", etc. allow designing or manufacturing tolerances and errors and mean "substantially vertical", "substantially parallel", "substantial plane", etc., respectively.

In the case that there are expressions that the dimensions or sizes on appearance are "same", "equal", and "different" in the above description, those expressions are not used in a strict sense. Those "same", "equal", "different", etc. allow designing or manufacturing tolerances and errors and mean "substantially same", "substantially equal", "substantially different", etc., respectively. It is to be noted, however, that when there are described given criterion values or sectionalizing values, such as threshold values or reference values, the terms "same", "equal", "different", etc. used therewith have their respective strict senses, dissimilar to the above.

In the above, arrows shown in FIG. 4 indicate an example of flows of signals, and are not intended to limit the directions of flow of the signals.

The flowchart of FIG. 8 is not intended to limit the present disclosure to the shown procedure, of which steps may be added or deleted or may be changed in the order. without departing from the spirit and technical idea of the present disclosure.

Other than the above, techniques based on the embodiment and the modification examples may appropriately be combined for utilization.

What is claimed is:

1. A printer comprising:

a feeder configured to transport an elongated medium that is to be consumed during printing fed out from a roll that includes an outer periphery around which said elongated medium is wound;

a pulse motor configured to drive said feeder;

a drive control device configured to output a pulse signal for driving said pulse motor;

a body to be detected that is configured to rotate in conjunction with rotation of said roll, and includes M (M is an integer greater than or equal to 2) detected elements along a circumferential direction;

an optical detection device configured to optically detect said detected elements of said body to be detected;

a processor; and a memory, said memory storing computer-executable instructions that, when executed by said processor, cause said printer to perform:

a comparison value calculation step;

an index value detection step; and a first determination step, said index value detection step including:

detecting a pulse count index value expressed by a pulse count of said pulse signal per one of said detected elements, in sequence for each of said detected elements, in accordance with transport of said elongated medium by said feeder driven by said pulse motor, said comparison value calculation step including:

a first process for calculating an N-th determination target value to be determined, from an N-th (N: an integer greater than or equal to 1) pulse count index value from start of transport and an $(N+1)^{th}$ pulse count index value adjoining the N-th pulse count index value, among a plurality of said pulse count index values detected in sequence at said index value detection step;

a second process for calculating a mean value of a plurality of consecutive pulse count index values within a predetermined range with its latest value being an $(N-1)^{th}$ pulse count index value when N is an odd number greater than or equal to 3 or an $(N-2)^{th}$ pulse count index value when N is an even number greater than or equal to 4, among the plurality of said pulse count index values detected in sequence at said index value detection step; and a third process for calculating a comparison value by comparing, with using a predetermined arithmetic operation, $(N-1)^{th}$ said determination target value among said determination target values calculated in sequence in said first process with said mean value calculated in said second process, said first process to said third process being performed in sequence while increasing N one by one with consumption of said elongated medium, said first determination step including determining whether said elongated medium wound around the outer periphery of said roll has reached a consumption completion status or not, on the basis of a magnitude relation between said comparison value calculated at said comparison value calculation step and a predetermined first threshold value.

2. The printer according to claim 1, wherein slits disposed on said body to be detected and portions between two adjacent said slits function as said detected elements.

3. The printer according to claim 1, wherein after detection of one of the detected elements by said optical detection device, said index value detection step is performed based on the result of the detection.

4. The printer according to claim 1, wherein after completion of detection of M pulse count index values equal to the number of said detected elements in said index value detection step, after start of transport by said feeder, in said second process of said comparison value calculation step, a mean value of latest said M pulse count index values within said predetermined range is calculated.

5. The printer according to claim 1, wherein before completion of detection of M pulse count index values equal to the number of said detected elements in said index value detection step, after start of transport by said feeder, in said second process of said comparison value calculation step, a mean value of less than said M pulse count index values within said predetermined range is calculated.

6. The printer according to claim 1, wherein in said first process of said comparison value calculation step, as said N-th determination target value, a total value of said N-th pulse count index value and said $(N+1)^{th}$ pulse count index value is calculated, and wherein in said third process of said comparison value calculation step, said comparison value is calculated by comparing $(N-1)^{th}$ said total value based on a result of calculation in said first process with said mean value calculated in said second process.

7. The printer according to claim 6, wherein in said third process of said comparison value calculation step, said comparison value is calculated by dividing said $(N-1)^{th}$ said total value based on the result of calculation in said first process by the double of said mean value calculated in said second process, and in said first determination step, it is determined that said elongated medium has reached said consumption completion status in the case that said comparison value calculated in said third process becomes greater than said first threshold value.

8. The printer according to claim 1, wherein said memory stores instructions that, when executed by said processor, cause said printer to further perform a second determination step for determining, separately from determination in said first determination step, whether said elongated medium has reached said consumption completion status or not, on the basis of a magnitude relation between latest said pulse count index value detected in said index value detection step and a predetermined second threshold value.

9. The printer according to claim 1, wherein in said first determination step, a determination related to said consumption completion status is not performed for a first predetermined period immediately after start of transport by said feeder and the determination related to said consumption completion status is started after the elapse of said first predetermined period.

10. The printer according to claim 1, further comprising a printing head configured to form print on a print-receiving medium, wherein said elongated medium is a thermal transfer ribbon configured to perform a thermal transfer on said print-receiving medium by heat from said printing head, or is said print-receiving medium.

11. The printer according to claim 10, further comprising a cutter configured to cut said print-receiving medium after print formation by said printing head, wherein in said first determination step, a determination related to said consumption completion status is not performed during a second predetermined period before and after a cutting action by said cutter, and the determination related to said consumption completion status is performed at timing other than said second predetermined period.

* * * * *